US005591556A

United States Patent [19]

Shimomura et al.

[11] Patent Number: 5,591,556

[45] Date of Patent: Jan. 7, 1997

[54] TONERS FOR DEVELOPING ELECTROSTATIC IMAGE

[75] Inventors: Hiroyoshi Shimomura, Sano; Yukinobu Hasegawa, Kurobe; Hiroshi Serizawa, Kazo; Masatoshi Maruyama, Oyama, all of Japan

[73] Assignee: Nippon Carbide Kogyo Kabushiki Kaisha, Tokyo, Japan

[21] Appl. No.: 356,575

[22] Filed: Dec. 15, 1994

Related U.S. Application Data

[63] Continuation-in-part of Ser. No. 961,872, Oct. 15, 1992, abandoned.

[51] Int. Cl.[6] ..... G03G 9/087

[52] U.S. Cl. ..... 430/109; 430/107; 430/111; 430/137

[58] Field of Search ..... 430/111, 109, 430/107, 137

[56] References Cited

U.S. PATENT DOCUMENTS

| | | | |
|---|---|---|---|
| 4,794,065 | 12/1988 | Hedvall et al. | 430/111 |
| 4,950,573 | 8/1990 | Yamaguchi et al. | 430/109 |
| 4,996,127 | 2/1991 | Hasegawa et al. | 430/111 |
| 5,225,304 | 7/1993 | Kabashima et al. | 430/111 |

FOREIGN PATENT DOCUMENTS

| | | | |
|---|---|---|---|
| 4284461 | 10/1992 | Japan | 430/111 |

*Primary Examiner*—Janis L. Dote
*Attorney, Agent, or Firm*—Sherman and Shalloway

[57] ABSTRACT

A toner for developing an electrostatic image comprises primary colored resin particles having a mean particle size of 0.6 to 10 microns which have been agglomerated to form secondary particles having a particle size of 1.2 to 20 microns. The primary colored resin particles are formed from fine elementary particles comprised of one or more polymers and a colorant. Thus, the toner can be economically prepared, is excellent in resolution, does not cause much fogging or scattering, and is excellent in fixability and image density.

9 Claims, 1 Drawing Sheet

TONERS FOR DEVELOPING ELECTROSTATIC IMAGE

This is a Continuation-In-Part of U.S. patent application Ser. No. 07/961,872, filed Oct. 15, 1992 now abandoned.

BACKGROUND OF THE INVENTION

1. Field of the Invention

This invention relates to a toner for developing an electrostatic image in electrophotography, electrostatic recording, electrostatic printing, etc.

2. Description of the Prior Art

Toners widely used in general have been hitherto produced by dry blending a styrene/acrylate copolymer powder resulting from suspension polymerization with a colorant such as carbon black, and optionally a charge control agent and/or a magnetic material, melt-kneading the blend with an extruder, etc., then pulverizing the resulting blend and classifying the pulverizate (see Japanese Laid-open Patent Application No. 23,354/1976).

The conventional toners obtained by the above method are, however, limited in controlling the particle size of the toners, and toner fine particles can hardly be formed in good yields. Besides, dispersion is nonuniform and electrostatic charge distribution becomes broad. Consequently, when they are used as a developer, there are unavoidable defects in that resolution is low, and fogging, scattering, etc. occur.

Therefor, polymer particle systems improving the above defects and other toner characteristics have been proposed from various purposes. For example, Yamaguchi, et al., U.S. Pat. No. 4,950,573 discloses a toner comprising thermoplastic base particles having a particle size of 5 to 25 micron and small particles having a particle size of not more than one-fourth that of the base particles and containing an organic polymer and colorant; Hedall et al., U.S. Pat. No. 4,794,065 discloses a toner comprising internally pigmented thermo-plastic base particles and thermoplastic fine particles containing a polar polymer wherein said fine particles are on the surface of the base particles; Hasegawa, et al., U.S. Pat. No. 4,996,127 and Masuda et al., Japanese unexamined Patent Publication No. 4-284461 disclose a toner comprising secondary particles which are formed by agglomerating primary particles containing polar polymer and coloring agent.

However, more improvement is demanded for obtaining a toner wherein in preparation of primary particles constituting the toner the yield of desired toner particles is good, and dispersion is uniform and electrostatic charge distribution is narrow, and which is excellent in development characteristics such as resolution and fogging.

Thus, the object of this invention lies in providing a toner for developing an electrostatic image in electrophotography in which toner the yield of desired toner particles is improved and dispersibility of colorants in the toner articles, etc. are improved.

SUMMARY OF THE INVENTION

The present inventors have found that the above object can be accomplished by providing toner particles containing secondary colored resin particles prepared by combining two kinds of resin particles, namely combining primary colored resin particles having a certain particle size with primary uncolored resin particles having a certain particle size, the primary colored resin particles being derived from plural fine elementary resin particles and colorants.

Thus, according to this invention, there is provided a toner for developing an electrostatic image comprising secondary particles having a mean particle size B of 1.2 to 20 microns, the said secondary particles being formed by agglomerating primary colored resin particles having the mean particle size $A_1$ of 0.6 to 10 microns and primary uncolored resin particles having a mean particle size $A_2$ of 0.6 to 10 microns, said primary colored resin particles being derived from colorants and plural fine elementary resin particles consisting of one or more polymer materials, said primary uncolored resin particles being derived from one or more polymer materials, and both or either of the colored resin particles and the uncolored resin particles containing a polar polymer.

Herein, the "fine elementary resin particles" mean resin particles for preparing the primary resin particles, wherein agglomerates formed by agglomeration of a plural number of the fine elementary resin particles have a mean particle size not exceeding the particle size of the primary colored resin particles derived from the fine elementary resin particles.

BRIEF DESCRIPTION OF THE DRAWINGS

FIG. 1(*b*) and 1(*e*), 1(*g*) and 1(*h*) are schematic examples of the section of secondary particles of the instantly claimed toner, in which black particles show primary colored resin particles and white particles show primary uncolored resin particles.

DETAILED DESCRIPTION OF THE INVENTION

Figure 1A:
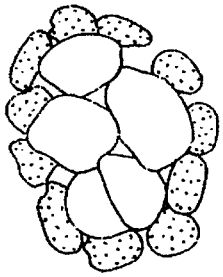
FIG. 1 is a rough sketch of cut surfaces showing examples of secondary particles 1(*a*) to 1(*h*) as toners of this invention.

The primary colored resin particles used in this invention are derived from colorants and plural fine elementary resin particles consisting of one or more polymer materials having a mean particle size ($A_1$) of 0.6–10 microns, preferably 0.8 to 8.0 microns, more preferably 1.0 to 5.0 microns, most preferably 1.0 to 3.0 microns. More specifically, the primary colored resin particles of the invention can suitably be obtained by a process comprising dispersing colorants in a resin emulsion or suspension and then spray drying the dispersion, or a method comprising causing association by the Z electric potential difference while colorants are dispersed in a resin emulsion or suspension. By such a process there can readily be obtained the colored resin particles having a good conversion efficiency of the resin used and being excellent in dispersibility of the colorants into the particles. When the particle size ($A_1$) of the primary particles is smaller than 0.6 microns, fogging and scattering notably occur. When it is larger than 10 microns, resolution becomes poor.

The primary particles of the uncolored resin used in this invention are polymer particles having a mean particle size ($A_2$) of 0.6 to 10 microns, preferably 0.8 to 8.0 microns, more preferably 1 to 5.0 microns, most preferably 1.0 to 3.0 microns. Said particles can suitably be obtained by emulsion polymerization, suspension polymerization, precipitation polymerization, interfacial polymerization, mechanical pulverization of synthetic resin pieces, or the like, preferably emulsion polymerization or suspension polymerization, or by conducting the process of obtaining the colored resin particles, without using the colorants. When the particle size ($A_2$) of the primary particles is smaller than 0.6 micron, resolution becomes poor. When it is larger than 10 microns, fogging and scattering notably occur.

The secondary particles of this invention are particles formed by agglomerating the primary particles. The mean secondary particle size (B) thereof is usually 1.2 to 20 microns, preferably 1.6 to 16 microns, more preferably 2 to 10 microns, most preferably 3 to 7 microns. When the mean particle size $A_1$ of the primary colored resin particles, the mean particle size $A_2$ of the primary uncolored resin particles and the mean particle size B of the secondary particles meets the following relationship $$\text{preferably } \frac{1}{2} \geqq \frac{A_1}{B} \geqq \frac{1}{40} \text{ or } \frac{1}{2} \geqq \frac{A_2}{B} \geqq \frac{1}{40},$$

$$\text{more preferably } \frac{1}{2} \geqq \frac{A_1}{B} \geqq \frac{1}{20} \text{ or } \frac{1}{2} \geqq \frac{A_2}{B} \geqq \frac{1}{20},$$

$$\text{most preferably } \frac{1}{3} \geqq \frac{A_1}{B} \geqq \frac{1}{10} \text{ or } \frac{1}{3} \geqq \frac{A_2}{B} \geqq \frac{1}{10},$$

a balance of scattering and resolution is good. When $A_1/B$ or $A_2/B$ is larger than ½, fogging and scattering come to notably occur. When $A_1/B$ or $A_2/B$ is smaller than 1/40, resolution becomes poor.

Methods for formation of secondary particles by agglomerating primary particles in this invention are not particularly limited. Generally, an association method such as a zeta-potential method, coacervation, interfacial polymerization, or the like, a method in which a boundary is heat fused and pulverization is then conducted, and the like are utilized. Especially preferable is the association method.

This invention is first characterized in that the secondary particles are composed of the primary colored resin particles and the primary uncolored resin particles. Heretofore, fine particles formed by uniformly dispersing colorants such as pigments and dyes in a binder resin have been used as a toner. In this case, when dispersibility of the colorant is poor, fogging and scattering occur; when resolution is improved by decreasing the particle size, scattering becomes heavy.

The present inventors have made studies to solve those problems, and have consequently found that when the primary colored resin particles and the primary uncolored resin particles are present respectively as separate phases in a toner, fogging and scattering do not occur while improving resolution. The amount of the primary uncolored resin particles is not particularly limited. In general, it is preferably 20 to 90% by weight, more preferably 30 to 60% by weight, most preferably 35 to 50 by weight based on the primary colored resin particles. When the amount of the primary uncolored resin particles is larger than 90% by weight, fogging and scattering occur heavily.

This invention is secondarily characterized in that the primary colored resin particles are derived from the fine elementary resin particles and the colorants. By adopting this constitution, the yield of the primary resin particles based on the starting resin particles is improved, and moreover, it becomes possible to hold the colorants uniform and stable in the resin particles.

The colored resin used in the present specification and claims indicates a resin containing not less than 0.5% by weight, preferably not less than 1% by weight, more preferably not less than 4% by weight, based on the polymer materials, of colorants such as pigments and dyes. The uncolored resin indicates a resin containing less than 0.5% by weight, based on the polymer materials, of the colorants, though a resin substantially free from the colorants is most preferable.

The relationship between the mean particle size $A_1$ of the primary colored resin particles and the mean particle size $A_2$ of the primary uncolored resin particles is not particularly limited. In general, it is preferably $A_1>A_2$ or $A_1<A_2$. For example, when $A_1$ is 2 to 5 times $A_2$, especially 2 to 3 times $A_2$, or $A_2$ is 2 to 5 times $A_1$ especially 2 to 3 times $A_1$, it is desirable from the aspect of a balance of fogging and scattering of the toner and resolution.

Regarding the particle sizes $A_1$ and $A_2$ of the primary particles forming the secondary particles, it is advisable that the mean particle size of the particles forming the relative inside of the secondary particles is larger than that of the particles forming the relative outside thereof. For instance, when the particle size of the primary particles in the inside is preferably 2 to 5 times, more preferably 2 to 3 times that of the primary particles in the outside, it is desirable from the aspect of a balance of fogging and scattering of the toner and resolution.

The polymer materials used for preparing the primary colored resin particles and the polymer materials used for preparing the primary uncolored resin particles, in this invention, may be the same or different, and can be composed of one or more polymers, respectively. The polymer materials can also be any of polar polymers and nonpolar polymers.

In a preferred embodiment of this invention, the polar polymer is used for preparing the primary colored resin particles, and the nonpolar polymer or the polar polymer is used for preparing the primary uncolored resin particles.

In the present specification, the polar polymer means a polymer having a polar bond in the molecule. The term "polar" means an ionic bond and also a covalent bond having nonuniform distribution of electron cloud owing to difference in negative polarity of atoms.

As these polymers can be exemplified polymers having polar groups such as carboxyl groups in the side chains, polymers such as polyesters having unblocked polar functional groups at both ends of the backbone chain, etc. The detail and other examples of the polymers having polarity used in this invention will be further clear in the following description.

A preferable example of the polymer having polarity is a copolymer of a styrene, an alkyl (meth)acrylate and a comonomer having an acidic polar group or a basic polar group (hereinafter referred to as a "comonomer having a polar group").

A preferable example of such a copolymer is a copolymer comprising (a) 90 to 20% by weight, preferably 70 to 30% by weight of a styrene based on the total weight of (a) and (b), (b) 10 to 80% by weight, preferably 30 to 70% by weight of an alkyl (meth)acrylate based on the total weight of (a) and (b), and (c) 0.05 to 30 parts by weight, preferably 1 to 20 parts by weight of a a polar group-containing comonomer, when the total weight of (a) and (b) is taken to be 100 weight parts.

The copolymer may optionally contain, besides the monomers (a), (b) and (c), another copolymerizable comonomer unless impairing performance of the toner in this invention.

Examples of the styrene are styrene, n-methylstyrene, m-methylstyrene, p-methylstyrene, alpha-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, and p-chloromethylstyrene. Stylene is most preferable.

Examples of the alkyl (meth)acrylate are methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, methyl alpha-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, and stearyl methacrylate. Of these, (meth)acrylates of aliphatic alcohols having 1 to 12 carbon atoms, preferably 3 to 8 carbon atoms, more preferably 4 carbon atom are used.

As the acid polar group-containing comonomer, (i) a carboxyl group (—COOH)-containing alpha,beta-ethylenically unsaturated compound and (ii) a sulfone group (—$SO_3H$)-containing alpha, beta-ethylenically unsaturated compound are usable.

Examples of the —COOH group-containing alpha, -beta-ethylenically unsaturated compound (i) are acrylic acid, methacrylic acid, fumaric acid, maleic acid, itaconic acid, cinnamic acid, monobutyl maleate, monoctyl maleate, and their salts with metals such as Na and Zn.

Examples of the —$SO_3H$ group-containing alpha, -beta-ethylenically unsaturated compound (ii) are sulfonated styrene, its Na salt, allylsulfosuccinic acid, octyl allylsulfosuccinate, and its Na salt.

The basic polar group-containing comonomer includes (i) a (meth)acrylate of an aliphatic alcohol having 1 to 12 carbon atoms, preferably 2 to 8 carbon atoms, more preferably 2 carbon atoms and containing an amine group or a quaternary ammonium group, (ii) a (meth)acrylic amide or a (meth)acrylic amide optionally mono- or di-substituted with an alkyl group having 1 to 18 carbon atoms on N, (iii) a vinyl compound substituted with a heterocyclic group having N as a ring member, and (iv) N,N-diallylalkylamine or its quaternary ammonium salt. Of these, the (meth)acrylate (i) of the aliphatic alcohol containing the amine group or the quaternary ammonium group is preferable.

Examples of (i) the (meth)acrylate of the aliphatic alcohol containing the amine group or the quaternary ammonium group are dimethylaminoethyl acrylate, dimethylaminoethyl methacrylate, diethylaminoethyl acrylate, diethylaminoethyl methacrylate, quaternary ammonium salts of the above four compounds, 3-dimethyl-aminophenyl acrylate, and 2-hydroxy-3-methacryloxypropyl-trimethylammonium salt.

Examples of (ii) the (meth)acrylic amide or the (meth-)acrylic amide optionally mono- or di-substituted with the alkyl group having 1 to 18 carbon atoms on N are acrylamide, N-butylacrylamide, N,N-dibutylacrylamide, Piperidylacrylamide, methacrylamide, N-butylmethacrylamide, N,N-dimethylacrylamide, and N-octadecylacrylamide.

Examples of (iii) the vinyl compound substituted with the heterocyclic group having N as the ring member are vinylpyridine, vinylpyrrolidone, vinyl N-methylpyridinium chloride, and vinyl N-ethylpyridinium chloride.

Examples of (iv) the N,N-diallylalkylamine are N,N-diallylmethylammonium chloride, and N,N-diallylethylammonium chloride.

The glass transition temperature of the polar group-containing polymer is –90° to 100° C., preferably –30° to 80° C., more preferably –10° to 60° C. When the glass transition temperature is higher than 100° C., low-temperature fixability tends to decrease undesirably. When it is lower than –90° C., flowability of the toner powder tends to decrease undesirably.

The other examples of the polymer containing the polar group in the side chain are modified polyolefins such as modified polypropylene and modified polyethylene, polyvinyl acetate, saponified polyvinyl acetate, polyvinyl alcohol, modified polyacrylonitrile, polybutyral, and natural waxes.

Meanwhile, examples of the polymer containing the polar functional group at both ends of the backbone chain are polyesters, epoxy resins, polyamides, polyurethanes, urea resins, and melamine resins.

Examples of the polyesters are polycondensates of polyhydric alcohols such as etherified bisphenol A and glycols and dibasic acids such as terephthalic acid, fumaric acid and maleic acid, and copolymers of three or more components including trimellitic acid and pyromellitic acid. It is advisable that the molecular weight of these polyesters is 2,000 to 200,000.

Examples of the epoxy resins are resins obtained by the reaction of epichlorohydrin and bisphenol A or polyhydric alcohols, and their modified products. It is advisable that the softening point of the epoxy resins is 90° to 200° C.

Examples of the nonpolar polymer that can be used in this invention are polystyrene, polyvinylidene chloride, polytetrafluoroethylene, natural waxes such as Carnauba wax and Candelilla wax, synthetic waxes such as montan wax, silicon-containing resins, melamine resins, synthetic rubber resins, polyurethane resins, poly(meth)acrylic acid esters, and copolymers thereof.

The degree of polymerization of polymers of the colored resin and the uncolored resin in this invention is not particularly limited. In general, the number mean degree of polymerization is 2,000 to 400,000, preferably 5,000 to 200,000, more preferably 8,000 to 100,000, and the weight mean degree of polymerization is preferably 3,000 to 800,000, more preferably 10,000 to 400,000.

It is advisable that in the toner of this invention, at least one of the colored resin and the uncolored resin contains the polar polymer.

When the polar polymer is a polymer having polar groups in the side chains, the amount of the polar group is preferaly 0.5 to 10% by weight, more preferably 1 to 5% by weight based on the weight of the polymer.

The term "colorant" referred to in the present specification means a coloring additive that gives a color necessary as an electrostatic image developer to said developer. Additives that impart to the developer properties such as magnetism and charge controlling property other than colorability, e.g., a magnetic material such as magnetite and a charge control agent such as a nigrosine dye are also included in the "colorant" if desirable colorability is given to the developer.

The colorant used in this invention includes inorganic pigments, organic pigments and organic dyes, the inorganic pigments and the organic pigments being preferable. One or more pigments, or/and one or more dyes may be used if required. Suitable examples of the inorganic pigments are as follows.

(a) a metallic pigment powder (b) a metallic oxide pigment (c) a carbon pigment (d) a sulfide pigment (e) a chromate pigment (f) a ferrocyanide pigment Examples of the metallic pigment powder (a) are a zinc powder, an iron powder and a copper powder.

Examples of the metallic oxide pigment (b) are magnetite, ferrite, red oxide, titanium oxide, zinc oxide, silica, chromium oxide, ultramarine, cobalt blue, cerulian blue, mineral violet and trilead tetroxide.

Examples of the carbon pigment (c) are carbon black, Thermatomic carbon, lamp black and furnace black.

Examples of the sulfide pigment (d) are zinc sulfide, cadmium red, selenium red, mercury sulfide, and cadmium yellow.

Examples of the chromate pigment (e) are molybdenum red, barium yellow, strontium yellow and chrome yellow.

An example of the ferrocyanide pigment (f) is milori blue.

Examples of the organic pigments are as follows.

(a) Azo Pigment

Hanza yellow, benzidine yellow, benzidine orange, permanent red 4R, pyrazolone red, lithol red, brilliant scarlet G and BON maroon light.

(b) Acid Dye-Type Pigment and Basic Dye-Type Pigment

Pigments formed by precipitating agent dyes such as orange II, acid orange R, Eosine, quinoline yellow, tartrazine yellow, acid green, peacock blue and alkali blue with a precipitating; pigments formed by precipitating dyes such as rhodamine, magenta, malachite green, methyl violet and victoria blue with tannic acid, tartar emetic, PTA, PMA or PTMA.

(c) Mordant Dye-Type Pigment

Metallic salts of hydroxyanthraquinones and alizarin madder lake.

(d) Phthalocyanine Pigment

Phthalocyanine blue and sulfonated copper phthalocyanine.

(e) Quinacridone Pigment and Dioxane Pigment

Quinacridone red, quinacridone violet and carbazole dioxazine violet.

Others

Organic fluorescent pigments and aniline black.

Nigrosine dyes and aniline dyes are used as the organic dyes.

The toner of this invention, as aforesaid, contains the charge control agent, the magnetic material, etc., if required. Examples of the charge control agent for plus are nigrosine-type electron donating dyes, metallic salts of naphthenic acid or higher fatty acids, alkoxylated amines, quaternary ammonium salts, alkylamides, chelates, pigments, and fluorinated activating agents. Examples of the charge control agent for minus are electron receiving organic complexes, chlorinated paraffins, chlorinated polyesters, polyesters containing an excessive amount of an acid group and copper phthalocyanine sulfonylamine.

The toner of this invention can be used with additives such as a fluidizing agent, etc., if required. Examples of the fluidizing agent are fine powders of hydrophobic silica, titanium oxide and aluminum oxide. The amounts of the powders are 0.01 to 5 parts by weight, preferably 0.1 to 1 part by weight per 100 parts by weight of the toner.

The toner for developing the electrostatic image in this invention may further contain a release agent if required. Examples of the release agent are metal salts of higher fatty acids such as Cd, Ba, Ni, Co, St, Cu, Mg and Ca salts of stearic acid; Zn, Mn, Fe, Co, Cu, Pb and Mg salts of oleic acid; Zn, Co, Cu, Mg, Al and Ca salts of palmitic acid; Zn, Co and Ca salts of linoleic acid; Zn and Cd salts of ricinoleic acid; Pb salt of caprylic acid; and Pb salt of caproic acid, as well as natural or synthetic paraffins and fatty esters, their partially saponified products, and alkylene-bis-fatty acid amides. They may be used either singly or in combination.

Suitable examples of a method for producing the toner in this invention are described below. As a method for producing the primary colored resin particles, there are a method in which a polymer suspension or emulsion containing fine resin particles is prepared in advance, colorants are mixed with the suspension or emulsion and the mixture is homogenized, and then the resultant suspension is spray dried to give particles having a specified particle size, and a method in which the fine resin particles and the colorants existing in the above dispersion are associated by the difference in their Z potentials in the dispersion to give particles having a specified particle size.

The primary uncolored resin particles can be produced either by removing the colorants in the method for producing the primary colored resin particles, or by pulverizing and classifying a resin in a molten state of certain polymer materials, or by suspension polymerizing certain monomers.

The secondary toner particles of this invention can be obtained in the form of an agglomerate of the above two types of the primary particles. Examples of a method for forming the agglomerate are a method in which the two types of the primary particles are coagulated with heat and pulverized, a method in which a mixed slurry of the two types of the primary particles is spray dried, and a method in which the particle sizes are adjusted in the slurry with a surface active agent and an effect of stabilizing a mean particle size with polarity of the surfaces of the primary particles while the two types of the primary particles are agglomerated by the difference of their Z potentials. The last method is preferable. Anyway, it is advisable that in the agglomerating step, the primary particles are heated at a temperature higher than Tg of the resin to heat-fuse them for stability (anti-pulverizability) thereof.

Moreover, in view of stabilizing the particle size with polarity, distribution of more polarity on either of the two types of the primary particles is better than uniform distribution of polarity on the two types of the primary particles. In this case, stability (pulverizability) and fixability of the particles tend to be excellent.

It is advisable that polarity is 2 to 50 in case of an acid value and 1 to 15 in case of an amine value.

The toner for developing the electrostatic image in this invention is a toner for developing an electrostatic image in which primary colored resin particles having a mean particle size of 0.6 to 10 microns and primary uncolored resin particles having a mean particle size of 0.6 to 10 microns and agglomerated to secondary particles having a mean particle size of 1.2 to 20 microns. Said toner brings forth effects that it improves greatly the defects of the hitherto used toners; particularly not only can be obtained from the used polymer materials at a good yield, but is excellent especially in resolution, causes less fogging and less scattering, and is excellent in fixability and image density.

This invention is illustrated by the following Examples specifically. In said Examples, "parts" and "%" are all by weight unless otherwise indicated.

By the way, a mean particle size of a toner, density at the time of development, fogging, resolution and fixability were tested by the following methods.

Test Methods

Particle Size

The primary colored resin particles and the primary uncolored resin particles were measured with a device manufactured by DLS Union Giken, K. K.

The agglomerated particles (toner) were measured by a Coulter counter of a multisizer type manufactured by Coulter K. K. (a mean volume value).

Density

Black reflection density was measured with an ND-504DE model differential colorimeter manufactured by Nippon Denshi Kogyo K. K. Color differences X, Y, Z were found, and density of an image (a flat black portion of Denshi Shashin Gakkai Test Chart NOI-R1975) was found by the following equation.

$$\text{Density}=2-\log(Y)$$

The higher the value, the better the image density.

Fogging

Whiteness was measured with the ND-504DE model differential colorimeter. Color differences L, a, b were found and fogging was calculated by the following equation $$\text{Fogging}(\%)=K/K_O\times 100$$

wherein $K_O$ is whiteness of a non-image portion before copying, calculated by the following equation $$K_O=100-((100-L)^2+a^2+b^2)^{1/2},$$

and

K is whiteness of a non-image portion after copying, calculated by the following equation $$K=100-((100-L)^2+a^2+b^2)^{1/2}.$$

The lower fogging value is better; 0.3 or lower is good and 0.5 or higher is bad.

Resolution

Denshi Shashin Gakkai Chart NOI-R1975 was copied, and a resolving power pattern (8.0 point) was magnified 100× with a optical microscope and estimated at the following grades by visual observation.

5—Fine lines are reproduced and fogging scarcely occurs between the fine lines.

4—Fine lines are reproduced but fogging is slightly observed between the fine lines.

3—Reproduction of fine lines is somewhat poor and fogging is observed a little more between the fine lines.

2—Reproduction of fine lines is bad and fogging is much observed between the fine lines.

1—Reproduction of fine lines is impossible and fine lines become one line.

The higher the value, the better the resolution; 4 or higher is good, and 3 or less is bad.

Fixability

A test was conducted by rubbing the image (image density 0.5 to 0.6) fixed at 180° C. 50 times with a cotton broad cloth under a load of 500 g by a flat method using a fastness tester manufactured by Showa Juki K. K. Image density (IDo) before testing and image density (IDa) after testing were found, and fixability was calculated by the following equation.

$$\text{Fixability}=IDa/IDo\times 100(\%)$$

The higher the value, the better the fixability.

REFERENTIAL EXAMPLES A

A. Production Example of Primary Colored Resin Particles

A-1

A condensation polyester (a molecular weight (Mw) 6,000; an acid value 35) from 47 mols of an alcohol obtained by adding 2 mols of ethylene oxide to bisphenol A and 53 mols of fumaric acid was pulverized to a mean particle size of about 20 microns. 30 parts of the pulverizate were dispersed in 70 parts of a 1% aqueous solution of a nonionic surface active agent (Noigen EM230D—a trademark for a product of Daiichi Kogyo Seiyaku Co., Ltd.), and the dispersion was adjusted to pH of 10 with ammonia.

Using a homogenizer (15-M-8PA Model: a trademark for a device manufactured by Gaulin), the dispersion was emulsified at 150° C. and 50 kg/cm$^2$. On this occasion, ammonia was gradually added to keep pH of the dispersion at 10. The mean particle size of the resulting polyester emulsion was 0.05 micron. Thus, emulsion containing plural fine elementary particles is prepared.

Subsequently, 3.6 parts of carbon (Regal 330 R—a trademark for a product of Cabot) were added to the emulsion at room temperature. While dispersing carbon with a dispersing unit, pH was adjusted to 7 with nitric acid. There was obtained a suspension of primary colored resin particles containing carbon and having a mean particle size of about 1 micron.

A-2

A-1 was repeated except that the amount of carbon was changed into 2.0 parts to obtain a suspension of primary colored resin particles having a mean particle size of about 2 microns.

A-3

A-2 was repeated except that pH was adjusted to 5.0 with nitric acid to obtain a suspension of primary colored resin particles having a mean particle size of about 4 microns.

A-4

Styrene (36 parts), 4 parts of butyl acrylate, and 0.2 part of acrylic acid were dispersed in 60 parts of an aqueous solution containing 0.4% of nonionic surface active agent (Noigen EM230D) and 1.0% of an anionic surface active agent (Neogen R). Potassium persulfate (0.2 part) was added, and emulsion polymerization was carried out at 80° C. for 4 hours to obtain an emulsion having a mean particle size of 0.2 micron. Then, under room temperature, 2.0 parts of carbon (Regal 330R) were added to the emulsion. While dispersing the carbon with a dispersing unit, pH was adjusted to 5.0 with nitric acid. There was obtained a suspension of primary colored resin particles containing carbon and having a particle size of about 2 microns.

A-5

A-4 was repeated except that the amount of acrylic acid was changed into 2.0 parts and the amount of carbon was changed into 3.0 parts. There resulted a suspension of primary colored resin particles having a mean particle size of about 2 microns.

A-6

Styrene (36 parts), 4 parts of butyl acrylate and 0.2 part of diethylaminoethyl acrylate were dispersed in 60 parts of an aqueous solution containing 0.4 part of a nonionic surface active agent (Noigen EM-230D) and 0.4 part of a cationic surface active agent (Catiogen H—a trademark for a product of Dai-ichi Kogyo Seiyaku Co., Ltd.). Then, 0.2 part of an azo-type polymerization initiator (V-50—a trademark for a product of Wako Junyaku K. K.) was added, and emulsion polymerization was conducted at 80° C. for 4 hours to obtain an emulsion having a mean particle size of 0.2 micron. Subsequently, under room temperature, 2.0 parts of carbon (Printex 150T—a trademark for a product of Degussa) were added to the emulsion. While dispersing carbon, pH was adjusted to 7 with ammonia to afford a suspension of primary colored resin particles containing carbon and having a mean particle size of about 2 microns.

A-7

A-6 was repeated except that the amount of diethylaminoethyl acrylate was changed into 1.0 part and the amount of carbon was changed into 3.0 parts. There resulted a suspension of primary colored resin particles having a mean particle size of about 2 microns.

A-8

A-4 was repeated except that carbon was replaced with 4 parts of a magenta color dispersion dye (Kayalon Red E-G1—a trademark for a product of Nippon Kayaku Co., Ltd.). There resulted a suspension of primary colored resin particles having a mean particle size of about 2 microns.

REFERENTIAL EXAMPLES B

B. Production Examples of Primary Uncolored Resin Particles

B-1

Styrene (35 parts) and 5 parts of butyl acrylate were dispersed in 60 parts of an aqueous solution containing 0.2% of a nonionic surface active agent (Noigen EM-230) and 0.2% of an anionic surface active agent (Neogen R), and 0.1 part of an azo-type polymerization initiator (V-50) was added. Emulsion polymerization was carried out at 80° C. for 4 hours to obtain an emulsion having Mw of 150,000 and Mn of 38,000 (a degree of polymerization) and a mean particle size of 0.3 micron.

Subsequently, while dispersing the emulsion with a dispersing unit under room temperature, pH was adjusted to 2.0 with nitric acid. There resulted a suspension of primary unclored resin particles having a mean particle size of about 4 microns.

B-2

B-1 was repeated except that pH was changed into 4.0 to obtain a suspension of primary uncolored resin particles having a mean particle size of about 1 micron.

B-3

While stirring the polyester emulsion obtained in A-1 with a dispersing unit at room temperature, pH was adjusted to 5 with nitric acid. There resulted a suspension of primary uncolored resin particles having a mean particle size of about 1 micron.

EXAMPLE 1

Figure 1B:
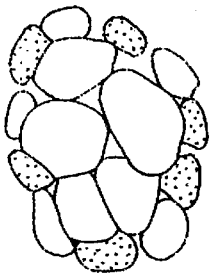
Figure 1C:
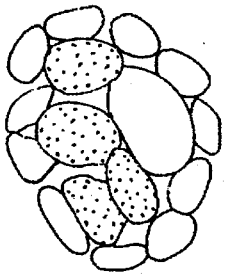
Figure 1D:
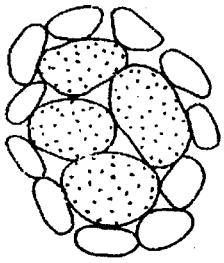
Figure 1E:
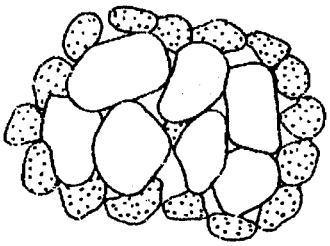
Figure 1F:
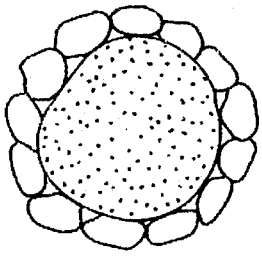
Figure 1G:
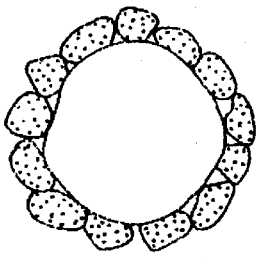
Figure 1H:
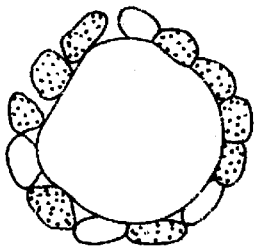

100 parts of the suspension obtained in Referential Example A-1, 50 parts of the suspension obtained in Referential Example B-1 and 150 parts of water were mixed, and the mixture was heated to 60° C. under stirring, followed by adjusting pH to 7 with ammonia. Then, the mixture was further heated and maintained at 90° C. for 2 hours. There resulted an agglomerate of primary colored resin particles and primary uncolored resin particles, having a mean particle size of about 5 microns. After cooling, the agglomerate was separated, washed with water and dried. The dried agglomerate was sliced with a microtome and observed with a transmission electron microscope. It was found to have a model structure shown in FIG. 1(*a*).

To the obtained agglomerate particles was added 0.6% of a hydrophobic silica (Aerosil R-972—a trademark for a product of Nippon Aerosil), and flushing was conducted five times with a juicer mixer to form a test toner. The toner was mixed with a commercial ferrite carrier (DFC-100C—a trademark for a product of Dowa Teppun Kogyo K. K.) coated with silicone by a ball mill for 1 hour to form a test developer having a toner density of 8%.

An amount of negative charge was 18 μc/g. A development test was carried out using a commercial copier (FT-6950—a trademark for a machine of Ricoh Co., Ltd.). There was obtained an image having excellent resolution with less fogging. Fixability was also good. The results are shown in Table 1.

EXAMPLE 2

Example 1 was repeated except that the suspensions were changed into 100 parts of the suspension obtained in Refrential Example A-3 and 50 parts of the suspension obtained in Referential Example B-2. There was obtained an agglomerate having a model structure, i.e., a mixture of 1(*f*) and 1(*c*) in FIG. 1, having a mean particle size of about 7 microns.

Moreover, a development test was carried out as in Example 1. The results are shown in Table 1.

EXAMPLE 3

Example 1 was repeated except that the suspensions were changed into 100 parts of the suspension obtained in Referential Example A-2 and 30 parts of the suspension obtained in Referential Example B-2. There was obtained an agglomerate having a model structure, i.e., a mixture of 1(*d*) and 1(*c*) in FIG. 1, having a mean particle size of about 4 microns.

Moreover, a development test was carried out as in Example 1. The results are shown in Table 1.

EXAMPLE 4

Example 1 was repeated except that the suspensions were changed into 100 parts of the suspension obtained in Referential Example A-4 and 30 parts of the suspension obtained in Referential Example B-2. There was obtained an agglomerate of the same structure as in Example 3, having a mean particle size of about 5 microns.

Moreover, a development test was carried out as in Example 1. The results are shown in Table 1.

EXAMPLE 5

100 parts of the suspension obtained in Referential Example A-6, 50 parts of the suspension obtained in Referential Example B-2 and 150 parts of water were mixed, and the mixture was heated to 60° C. under stirring, followed by adjusting pH to 4 with nitric acid. Then, the mixture was further heated and maintained at 95° C. for 2 hours. There resulted an agglomerate of primary colored resin particles and primary uncolored resin particles, having a mean particle size of about 6 microns. After cooling, the aggromerate was separated, washed with water and dried. The resulting product was sliced with a microtome, and observed with a transmission electron microscope. As a result, it was found to have a model structure as shown in Example 3.

To the obtained agglomerate were added 0.3% of a hydrophobic silida (Aerosil R-972) and 0.3% of alumina (Aerosil Aluminum Oxide C—a trademark for a product of Nippon Aerosil). Flushing was conducted five times with a juicer mixer to obtain a test toner.

Said toner was mixed with a commercial ferrite carrier (DFC-100C) coated with silicone by a ball mill for 1 hour such that toner density became 8% to form a test developer. An amount of positive charge was 14 μc/g. A development test was conducted using a commercial copier (SF-8500—a trademark for a machine of Sharp Corporation). As a result, an image having excellent resolution with less fogging was obtained. The results are shown in Table 1.

EXAMPLE 6

Example 5 was repeated except that the suspensions were changed into 100 parts of the suspension obtained in Referential Example A-7 and 30 parts of the suspension obtained in Referential Example B-2. There resulted an agglomerate of the same structure as in Example 3, having a mean particle size of about 4 microns.

A development test was conducted as in Example 5. The results are shown in Table 1.

EXAMPLE 7

Example 1 was repeated except that the suspensions were changed into 100 parts of the suspension obtained in Referential Example A-2 and 50 parts of the suspension obtained in Referential Example B-3. There resulted an agglomerate of the same structure as in Example 3, having a mean particle size of about 8 microns.

A development test was conducted as in Example 1. The results are shown in Table 1.

EXAMPLE 8

Example 1 was repeated except that the suspensions were changed into 100 parts of the suspension obtained in Referential Example A-8 and 30 parts of the suspension obtained in Referential Example B-2. There resulted an agglomerate of the same size as in Example 3, having a mean particle size of about 5 microns.

A development test was conducted as in Example 1. The results are shown in Table 1.

COMPARATIVE EXAMPLE 1

Example 1 was repeated except that the suspension obtained in Referential Example B-1 was not used. There resulted an agglomerate of only primary colored resin particles having a mean particle size of about 8 microns.

A development test was conducted as in Example 1. The results are shown in Table 1.

COMPARATIVE EXAMPLE 2

100 parts of the polyester used in Example 1 and 6 parts of carbon were kneaded with a Bunbery mixer, and the mixture was pulverized to about 8 microns with a jet mill. The powder was treated as in Example 1, and a development test was carried out as in Example 1. The results are shown in Table 1.

TABLE 1

| | Test results | | | |
|---|---|---|---|---|
| | Density | Fogging | Resolution | Fixability |
| Example | | | | |
| 1 | 1.3 | 0.1 | 5 | 90 |
| 2 | 1.4 | 0.2 | 4 | 90 |
| 3 | 1.2 | 0.2 | 4 | 85 |
| 4 | 1.2 | 0.1 | 5 | 85 |
| 5 | 1.4 | 0.3 | 4 | 90 |
| 6 | 1.2 | 0.1 | 4 | 85 |
| 7 | 1.3 | 0.2 | 4 | 95 |
| 8 | 1.3 | 0.1 | 5 | 85 |
| Comparative Example | | | | |
| 1 | 1.4 | 0.5 | 3 | 65 |
| 2 | 1.2 | 1.1 | 1 | 55 |

Further Comparative Experiment

On the basis of Example 4, there were prepared toners by changing the ratio ($A_1/A_2$) of the size ($A_1$) of primary colored resin particles and the size ($A_2$) of primary uncolored resin particles. The resultant toners were determined as to the image density, fogging, resolving power and fixability in accordance with the aforementioned testing method. Its result obtained is compared with that in the case of Example 4.

a) Run No. 1

Preparation of Primary Colored Resin Particles

A monomeric mixture consisting of 36 parts of styrene, 4 parts of n-buthyl acrylate and 0.2 part of an acrylic acid was dissolved in 60 parts of an aqueous solution containing 0.4% of a nonionic emulsifier (Noigen EM-230D) and 1.0% of an anionic emulsifier (Noegen R). Then 0.2 part of potassium persulfate was added to the dispersion and its polymerization was carried out at 80° C. for four hours under stirring thereby to afford an emulsion having a particle size of 0.2 micron. Successively, at room temperature 2.0 parts of carbon (Regal 330R) was added to this emulsion. While dispersing the carbon with a disperser, its pH was adjusted to 5.0 with a nitric acid. Further, while continuing the same stirring the pH was adjusted to 5.7 with ammonia by increasing the temperature to 45° C. There was obtained a suspension of primary colored resin particles containing carbon and having a mean particle size of about 1 μm.

Preparation of Primary Uncolored Resin Particles

A suspension of primary uncolored resin particles having a mean particle size of about 1 μm was obtained as in Referential Example B-2.

Preparation of Toners

In the same way as that of Example 4 were mixed 100 parts of the above suspension of the primary colored resin particles, 30 parts of the above suspension of the primary uncolored resin particles and 150 parts of water. The mixture was then warmed to 60° C. under stirring and its pH was adjusted to 7 with ammonia. The mixture was further warmed and maintained at 90° C. for two hours. There resulted an agglomerate of primary colored resin particles and primary uncolored resin particles having a mean particle size of about 5 microns. After cooling, the agglomerate was separated, washed with water and dried. To the dried agglomerate was added 0.6% of hydrophobic silica (R-972). There were obtained a test toner and a test developer as in Example 4.

b) Run No. 2

Preparation of Primary Colored Resin Particles

There was obtained a suspension of primary colored resin particles having a mean particle size of about 2 microns as in Referential Example 4.

Preparation of Primary Uncolored Resin Particles

A monomeric mixture consisting of 35 parts of styrene and 5 parts of n-buthyl acrylate monomers was dissolved in 60 parts of an aqueous solution containing 1.0% of a nonionic emulsifier (Noigen EM-230D) and 1.5% of an anionic emulsifier (Neogen R). Then 0.2 part of an azo type polymerization initiator was added to the dispersion and its polymerization was carried out at 80° C. for four hours under stirring thereby to afford an emulsion having a mean particle size of 0.15 micron. Successively, while stirring this emulsion with a disperser at room temperature, its pH was adjusted to 4.8 with a nitric acid. Further, while continuing the same stirring, its pH was adjusted to 5.7 with ammonia by increasing the temperature to 40° C. There was obtained a suspension of primary uncolored resin particles having a mean particle size of about 0.27 micron.

Preparation of Toners

In the same way as that of Example 4, there were mixed 100 parts of the above suspension of the primary colored resin particles, 30 parts of the above suspension of the primary uncolored resin particles and 150 parts of water. The mixture was then warmed to 60° C. under stirring and its pH was adjusted to 6.8 with ammonia. The mixture was further warmed and maintained at 90° C. for two hours. There resulted an agglomerate of primary colored resin particles and primary uncolored resin particles having a mean particle size of about 5 microns. After cooling, the agglomerate was separated, washed with water and dried. To the dried agglomerate was added 0.6% of hydrophobic silica (R-972). There were obtained a test toner and a test developer as in Example 4.

c) Run No. 3

Preparation of Primary Colored Resin Particles

There was obtained a suspension of primary colored resin particles having a mean particle size ($A_1$) of about 3.4 microns as in Referential Example A-4, except that in dispersing the carbon with dispersing unit, pH was adjusted to 4.0.

Preparation of Primary Uncolored Resin Particles

A monomeric mixture consisting of 35 parts of styrene and 5 parts of n-buthyl acrylate was dissolved in 60 parts of an aqueous solution containing 1.0% of a nonionic emulsifier (Noigen EM-230D) and 0.5% of an anionic emulsifier (Neogen R). Then 0.2 part of an azo type polymerization initiator was added to the dispersion and its polymerization was carried out at 85° C. for four hours under stirring thereby to afford an emulsion having a mean particle size of 0.2 micron. Successively, while stirring this emulsion with a disperser at room temperature, its pH was adjusted to 3.5 with a nitric acid. Further, while continuing the same stirring, its pH was adjusted to 3.7 with ammonia by increasing the temperature to 40° C. There was obtained a suspension of primary uncolored resin particles having a mean particle size ($A_2$) of about 0.7 micron.

Preparation of Toners

In the same way as in Example 4 of the specification of this application there were mixed 100 parts of the above suspension of the primary colored resin particles, 30 parts of the above suspension of the primary uncolored resin particles and 150 parts of water. The mixture was then warmed to 60° C. under stirring and its pH was adjusted to 6.8 with ammonia. The mixture was further warmed and maintained at 90° C. for two hours. There resulted an agglomerate of primary colored resin particles and primary uncolored resin particles having a mean particle size of about 5 microns. After cooling, the agglomerate was separated, washed with water and dried. To the dried agglomerate was added 0.6% of hydrophobic silica (R-972). There were obtained a test toner and a test developer as in Example 4.

Shown in the following Table are the testing results obtained by using the toners of the above Runs Nos. 1, 2 and 3 and by repeating the testing method set forth in the specification of this application.

TABLE

| Testing items of this application | Toner of Run No. 1 | Toner of Run No. 2 | Toner of Run No. 3 | Toner of Example 4 of this application |
|---|---|---|---|---|
| Image density | 0.85 | 1.15 | 1.30 | 1.2 |
| Fogging | 1.2 | 1.1 | 0.2 | 0.1 |
| Resolution | 3 | 4 | 5 | 5 |
| Fixability | 65% | 70% | 85% | 85% |
| $A_1$ | 1 | 2 | 3.4 | |
| $A_2$ | 1 | 0.27 | 0.7 | |
| $A_1/A_2$ | 1 | 7.4 | 4.9 | 2 |

As is clear from the above Table, the toners in Runs Nos. 1 and 2 were entirely inferior to the toner of Runs No. 3 (the present invention) and the toner of Example 4 of this application. It is judged from the foregoing that there is no effect of the present invention if the instantly claimed toner is not sufficient as a toner of the agglomerate of primary colored resin particles and primary uncolored resin particles and unless the ratio ($A_1/A_2$) of its mean particle sizes falls into a range of 2 to 5.

What we claim is:

1. A toner for developing an electrostatic image comprising secondary particles having a mean particle size B of 1.2 to 20 microns, each said secondary particle comprising a plurality of primary colored resin particles and a plurality of primary uncolored resin particles, said secondary particles comprising primary colored resin particles having a mean particle size $A_1$ of 0.6 to 10 microns and primary uncolored resin particles having a mean particle size $A_2$ of 0.6 to 10 microns, said primary colored resin particles comprising a colorant and plural elementary resin particles consisting of one or more polymer materials, said primary uncolored resin particles comprising one or more polymer materials, and both or either of the primary colored resin particles and the primary uncolored resin particles containing a polar polymer; and.

$$\frac{1}{2} \geqq \frac{A_1}{B} \geqq \frac{1}{40}$$

or $$\frac{1}{2} \geqq \frac{A_2}{B} \geqq \frac{1}{40}.$$

2. The toner of claim 1, wherein the primary uncolored resin particles comprise plural elementary particles consisting of one or more polymer materials.

3. The toner of claim 1, wherein the elementary particles in the primary colored resin particles and the primary uncolored resin particles comprise a polar polymer.

4. The toner of claim 1, wherein the secondary particles are formed by agglomeration between the primary colored resin particles and the primary uncolored resin particles.

5. The toner of claim 1, wherein the primary colored resin particles are formed by agglomeration between the elementary resin particles and the colorant.

6. A toner of claim 1, wherein when the mean particle size of the primary colored resin particles is expressed as $A_1$ and the mean particle size of the primary uncolored resin particles is expressed as $A_2$, the ratio between $A_1$ and $A_2$ meets the following equation $$A_1/A_2=2 \text{ to } 5$$

or $$A_2/A_1=2 \text{ to } 5.$$

7. The toner of claim 6, wherein the primary uncolored resin particles having a mean particle size $A_2$ are present in an amount of 20 to 90% by weight based on the primary colored resin particles having a mean particle size $A_1$.

8. The toner of claim 7, wherein the primary uncolored resin particles having a mean particle size $A_2$ are present in an amount of 35 to 50% by weight based on the primary colored resin particles having a mean particle size $A_1$.

9. The toner of claim 1, wherein said polar polymer is a polycondensate comprised of an etherified bisphenol A and a dibasic acid; or styrene-co-alkyl (meth)acrylate-co-(meth)acrylic acid; or styrene-co-alkyl(meth)acrylate-co-dialkylaminoethyl-(meth)acrylate, wherein said dialkylaminoethyl (meth)-acrylate is selected from the group consisting of dimethylaminoethyl acrylate, dimethylaminoethyl methacrylate, diethylaminoethyl acrylate and diethylaminoethyl methacrylate.

* * * * *